US010577683B2

(12) United States Patent
Vichery et al.

(10) Patent No.: US 10,577,683 B2
(45) Date of Patent: Mar. 3, 2020

(54) ALUMINIUM ALLOY SHEET FOR METALLIC BOTTLE OR AEROSOL CONTAINER

(71) Applicant: CONSTELLIUM FRANCE, Paris (FR)

(72) Inventors: Herve Vichery, Rustenhart (FR); Emilie Lae, Grenoble (FR); Michel Striebig, Colmar (FR)

(73) Assignee: CONSTELLIUM FRANCE, Paris (FR)

( * ) Notice: Subject to any disclaimer, the term of this patent is extended or adjusted under 35 U.S.C. 154(b) by 561 days.

(21) Appl. No.: 14/891,017

(22) PCT Filed: May 13, 2014

(86) PCT No.: PCT/FR2014/000104
§ 371 (c)(1),
(2) Date: Nov. 13, 2015

(87) PCT Pub. No.: WO2014/184450
PCT Pub. Date: Nov. 20, 2014

(65) Prior Publication Data

US 2016/0083825 A1 Mar. 24, 2016

(30) Foreign Application Priority Data

May 17, 2013 (FR) ..... 13 01143

(51) Int. Cl.
*B21B 1/46* (2006.01)
*C22F 1/047* (2006.01)
(Continued)

(52) U.S. Cl.
CPC ..... *C22F 1/047* (2013.01); *B21B 1/46* (2013.01); *B65D 1/0207* (2013.01); *B65D 83/38* (2013.01);
(Continued)

(58) Field of Classification Search
CPC ..... B21B 1/46; B21B 2001/221; B21B 2003/001; B21D 22/28; B21D 51/26;
(Continued)

(56) References Cited

U.S. PATENT DOCUMENTS 3,032,448 A * 5/1962 Siebel ..... C22C 21/08 148/537
4,039,355 A * 8/1977 Takahashi ..... C22C 21/08 148/415
(Continued)

FOREIGN PATENT DOCUMENTS

| | | | |
|---|---|---|---|
| EP | 0740971 | A1 | 11/1996 |
| EP | 1870481 | A1 | 12/2007 |
| FR | 2432555 | A1 | 2/1980 |
| JP | 0760386 | A | 3/1995 |
| JP | 10330897 | A | 12/1998 |
| JP | H10330897 | A | 12/1998 |
| JP | 2003082429 | A | 3/2003 |
| WO | 0115829 | A1 | 3/2001 |

OTHER PUBLICATIONS

International Search Report from PCT/FR2014/000104, dated Sep. 24, 2014.

*Primary Examiner* — Edward T Tolan
(74) *Attorney, Agent, or Firm* — McBee Moore & Vanick IP, LLC

(57) ABSTRACT

The invention relates to a process for the manufacture of an aluminum alloy sheet for metal bottles or aerosol cans.

The invention also relates to a sheet manufactured by a process such as that described above, together with metal bottles or bottle-cans, together with aerosol cans or aerosol dispensers made from the said sheet.

19 Claims, 2 Drawing Sheets

(51) Int. Cl.

| | |
|---|---|
| ***B65D 83/38*** | (2006.01) |
| ***C22C 21/08*** | (2006.01) |
| ***C22F 1/04*** | (2006.01) |
| ***C22C 21/06*** | (2006.01) |
| ***C22C 21/00*** | (2006.01) |
| ***B65D 1/02*** | (2006.01) |
| *B21B 1/22* | (2006.01) |
| *B21B 3/00* | (2006.01) |

(52) U.S. Cl.
CPC ..... *C22C 21/00* (2013.01); *C22C 21/06* (2013.01); *C22C 21/08* (2013.01); *C22F 1/04* (2013.01); *B21B 2001/221* (2013.01); *B21B 2003/001* (2013.01)

(58) Field of Classification Search
CPC ..... B21D 51/2638; B65D 1/0207; C22F 1/04; C22F 1/047; C22F 1/07; C22F 1/043; C22F 1/05; C22C 21/00; C22C 21/06; C22C 21/08
See application file for complete search history.

(56) References Cited

U.S. PATENT DOCUMENTS

| | | | | |
|---|---|---|---|---|
| 4,282,044 | A | 8/1981 | Robertson et al. | |
| 6,579,387 | B1 | 6/2003 | Selepack et al. | |
| 65,793,873 | | 6/2003 | Selepack et al. | |
| 2002/0043311 | A1 | 4/2002 | Selepack et al. | |
| 2003/0015261 | A1* | 1/2003 | Bull | C22C 21/02 148/551 |
| 2004/0035871 | A1* | 2/2004 | Chupak | B21D 22/28 220/608 |
| 2009/0053099 | A1* | 2/2009 | Kajihara | C22C 21/00 420/535 |
| 2015/0101382 | A1* | 4/2015 | Selepack | B21B 1/46 72/200 |

* cited by examiner

ALUMINIUM ALLOY SHEET FOR METALLIC BOTTLE OR AEROSOL CONTAINER

CROSS REFERENCE TO RELATED APPLICATIONS

This application is a § 371 National Stage Application of PCT/FR2014/000104, filed 13 May 2014, which claims priority to FR 13/01143, filed 17 May 2013.

BACKGROUND

Field of the Invention

The invention relates to the field of aluminum alloy metal bottles and aerosol cans, also known by those skilled in the art by the name of "bottle-cans" or "bottle beverage cans" and aerosol cans respectively, manufactured by drawing-ironing, i.e. by means of a process including these two basic stages, associated in particular with supplementary stages of necking, and possibly threading and curling.

The invention relates more particularly to aluminum alloy sheets having a composition and receiving heat treatment which are particularly suitable for this type of application and in particular have a good ability to be shaped in the aforementioned stages, in particular in necking, as well as low anisotropy, which is required in the stages of stamping and drawing in particular.

Description of Related Art

Aluminum alloys are increasingly used in the manufacture of beverage containers, also known as "cans" or "beverage cans", but also metal bottles or "bottle-cans" and aerosol cans, because of their very good aesthetic appearance, in particular in comparison with plastics materials and steels, and their suitability for recycling and corrosion resistance.

Unless otherwise stated, all aluminum alloys discussed below are designated according to the designations defined by the "Aluminum Association" in the "Registration Record Series" that it publishes regularly.

Cans, also known by those skilled in the art as "beverage cans", are manufactured by drawing-ironing from type 3104 alloy sheets in metallurgical condition H19.

This metallurgical condition, which is well known to those skilled in the art, corresponds to the continuous vertical casting of sheet, followed by scalping, homogenisation, and hot rolling followed by cold rolling in several passes with an overall cold reduction ratio of 80 to 90% without intermediate annealing.

The sheet undergoes a first cutting and shaping operation; in the course of this stage the coil of sheet is fed to a press, also known as a "cupper", which cuts out discs known as blanks and carries out a first stamping operation to produce "cups".

The cups are then delivered to a second press or "bodymaker" where they undergo a second stamping, also known as stamping, and several successive drawing operations; these comprise causing the shaped blank to pass through ironing dies to stretch the metal and thin it. As for the base, this is shaped in the form of an inverted dome so that it can withstand the internal pressure produced by the contents.

Thus cans whose walls are thinner than the base are progressively obtained. These cans are then processed in a machine which imparts rotary motion to them while a shear cuts them off to the desired height.

They are then washed in several cleaning and rinsing baths and then dried, typically at between 180 and 250° C. for 5 to 10 minutes.

They are then printed using rollers and varnished on the outside, with baking typically between 200 and 230° C. for 5 to 10 minutes.

A coating is then vaporized within the pre-shaped member before further baking typically between 190 and 220° C. for 3 to 10 minutes.

The can obtained at this stage is known as a "preform".

The beverage cans are then delivered to a necking and flanging station, which is also known as a "necker flanger" where the top of the preform undergoes several successive reductions in diameter and edging intended for the subsequent fitting of the lid.

Aluminum alloy metal cans and aerosol cans are conventionally manufactured by impact extrusion starting with slugs produced by wheel casting.

The first aluminum alloy bottles or "bottle-cans" manufactured by drawing-ironing and then necking appeared in Japan in 1993 and in Europe in 1995.

Evidence of this are patent applications JP 7060386 by Toyo Rikagaku Kenkyusho of 1993 and EP 0740971 by Hoogovens with a priority of 1995.

These bottles do not however have a monobloc structure. In fact, the vertical walls and the neck of the can are manufactured from the base of the preform and the lid is crimped onto the top of the preform.

This is also the case in application WO 0115829 by Daiwa Can in 2000 with a priority of 1999, which claims an aluminum alloy bottle manufactured by hot forming using complex tooling.

The manufacture of bottles of the "bottle-can" type or aerosol cans from aluminum alloy essentially by drawing-ironing and necking in fact requires a material which is capable of:

- undergoing extensive deep drawing, that is to say the formation of cups with vertical walls and a horizontal bottom, with stamping ratios, that is to say the ratio between the diameter of the blank and the diameter of the punch, of up to 1.9 or more, with great deformation during necking, so as to achieve a significant reduction in diameter in two stamping passes (stamping and restamping) only,
- providing cups of good quality, that is to say free from the defects known to those skilled in the art as "earing", or folds, to avoid any breakage during subsequent shaping,
- accepting deformation during necking without breaking, in the course of which the diameter of the preform is reduced by of the order of 50% in the case of bottles and during the shaping of the thread and the curl in the case of bottles, and the curl in the case of aerosol cans; these threading or curling operations here replace the simpler operation of edging beverage cans,
- enabling the completed bottle or aerosol can to withstand a sufficient "reversal and/or bursting pressure". The latter, well known to those skilled in the art, corresponds to the value of the internal pressure at which the base of the can reverses or bursts when it is subjected to increasing pressure; typically this varies between 5 to 20 bars depending upon the type of application.

Monobloc aluminum alloy bottles or "bottle-cans", essentially manufactured by drawing-ironing and then necking, appeared in Japan in the 2000s. Evidence of this is application JP 2003082429 by Kobe Steel with a priority of 2001.

The alloy claimed here is of type 3104 in metallurgical condition H19.

The same applies to application EP 1870481 with a priority of 2005 again by Kobe Steel.

A solution of this type is also used in mass production particularly in the United States.

However this material has the disadvantage of non-optimal forming with regard to stamping and above all necking.

In particular, after the "cups" have been stamped, the shape of the perimeter which is developed, known by those skilled in the art as "earing" is unsatisfactory.

This is in fact a profile with six ears, two of which are positioned at 0 and 180° respectively to the direction of rolling and four at 45° on either side of the said direction, as shown in FIG. 1.

It is found that such a configuration runs a serious risk of giving rise to the phenomenon of "earing" well known to those skilled in the art, because of the ears at 0 and 180°, with the risk of breaking during subsequent drawing.

Furthermore, the material does not soften greatly, that is to say that its mechanical strength decreases little when the varnishes are baked, which makes shaping by necking more difficult.

SUMMARY

The aim of the invention is to overcome these difficulties by allowing cups to be deep drawn with stamping ratios of up to 1.9 or even more, drawing without breaking and above all shaping by necking with a reduction of the order of 50% in the diameter of the "preform", without cracks or folds, as when "drawing" in the case of bottles and curling in the same case and in the case of aerosol cans.

The object of the invention is a process for manufacturing aluminum alloy sheet for metal bottles or aerosol cans manufactured by drawing-ironing and necking, having the following stages:

Casting a slab of aluminum alloy having a composition (% by weight):

Si: 0.10-0.35, Fe: 0.30-0.55, Cu: 0.05-0.20, Mn: 0.70-1.0, Mg: 0.80-1.30, Zn: ≤0.25, Ti: <0.10, other elements <0.05 each, and <0.15 in all, the remainder aluminum, Scalping and homogenization of the slab at a temperature of 550 to 630° C. for at least one hour, Hot rolling, First cold rolling stage with a reduction ratio of 35 to 80%, Recrystallization annealing at a temperature of 300 to 400° C. for at least one hour, Repeated cold rolling with a reduction ratio of 10 to 35% to a thickness of 0.35 to 1.0 mm, Preferably the recrystallization annealing is carried out for a period of at least one hour at a temperature of 340 to 360° C.

According to an advantageous variant, the aluminum alloy has the following composition (% by weight):

Si: 0.20-0.30, Fe: 0.35-0.50, Cu: 0.05-0.15, Mn: 0.80-0.90, Mg: 1.15-1.25, Zn: ≤0.25, Ti: <0.10, other elements <0.05 each, and <0.15 in all, the remainder aluminum.

The invention also relates to a sheet manufactured by a process such as that described above, the yield stress of which after 10 minutes heat treatment at 205° C., simulating baking of the varnishes, is 170 to 200 MPa and the ultimate tensile strength is 200 to 230 MPa.

Preferably the decrease in the yield stress of the said sheet before and after heat treatment simulating baking of the varnishes is 20 to 40 MPa.

According to an advantageous embodiment, the anisotropy index of the said sheet measured after cold rolling to a thickness of 0.35 to 10 mm by the cup method according to standard NF EN 1669 is 0.5 to 4.0%.

Even more advantageously, on completion of the test using the cup method the said sheet has ears at 45° on either side of the direction of rolling and no ears at 0 and 180° C. to the said direction.

According to a preferred embodiment the formability of the said sheet is such that it shows no cracks or folds during extensive deep drawing in two passes, the first with an stamping ratio, the ratio between the diameter of the blank and the diameter of the punch, between 1.5 and 1.9, the second with a stamping ratio of between 1.3 and 1.6.

Even more preferably, after cold rolling to a thickness of 0.35 to 1.0 mm, the said sheet has a microstructure with elongated grains with an aspect ratio, the ratio of the grain size in the direction of rolling in relation to the grain size in the direction of the thickness, of between 2 and 10 measured after anodic oxidation and by optical microscopy in polarized light.

The invention also relates to a metal bottle, also known to those skilled in the art as "bottle-cans" or "bottle-type beverage cans" manufactured from such sheet having one or more of the aforementioned characteristics, including shaped metal bottles, that is to say those whose main walls are not strictly cylindrical.

It also relates to aerosol containers, also known to those skilled in the art as "aerosol cans", or "aerosol dispensers", manufactured from the said sheet having one or more of the aforesaid characteristics, including a shaped aerosol can, that is one whose main walls are not strictly cylindrical.

The solid line section, with ears in particular at $\alpha$=0 and 180°, corresponds to a cup according to the prior art of type 3104 alloy in the H19 state, and the dotted line profile a cup produced from sheet according to the invention using type 3104 alloy in the H14 state with intermediate annealing. The ears at $\alpha$=0 and 180° are absent.

Figure 2:
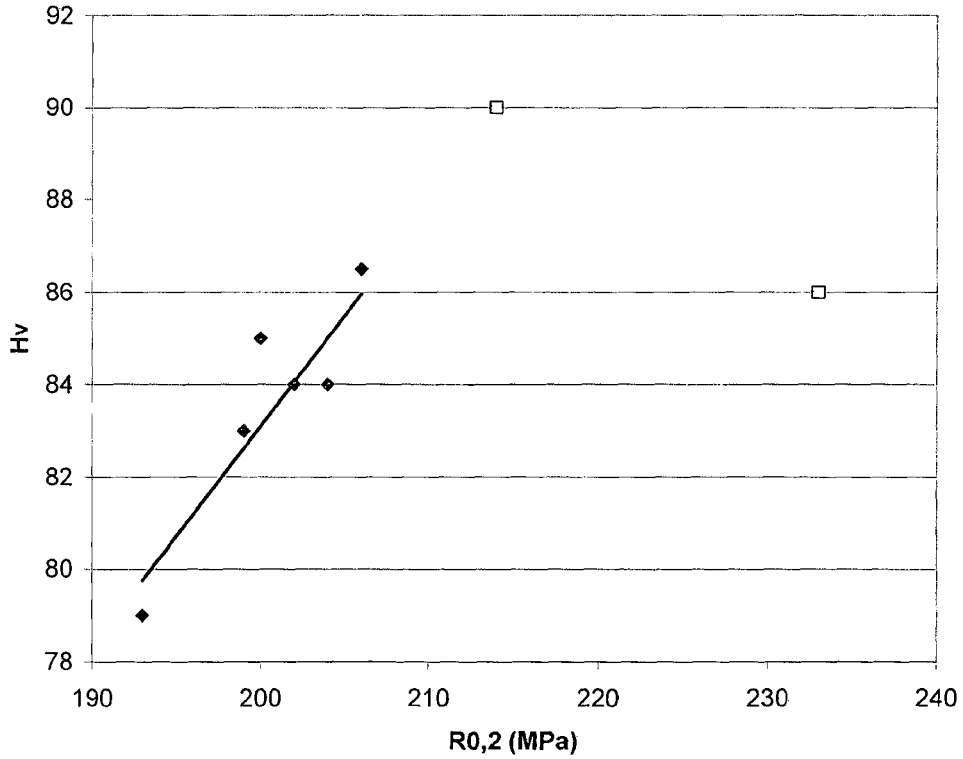

FIG. 2 shows the Vickers Hv microhardness of preforms prior to necking (having thus undergone baking of the varnishes) measured under a load of 100 g as a function of the R0.2 yield strength in MPa measured on the sheets before processing but after treatment simulating the baking of varnishes at 205° C. for 10 minutes.

The black lozenges correspond to the material according to the invention, and the white squares to materials not according to the invention.

This shows a linear correlation between these two values.

Figure 3:
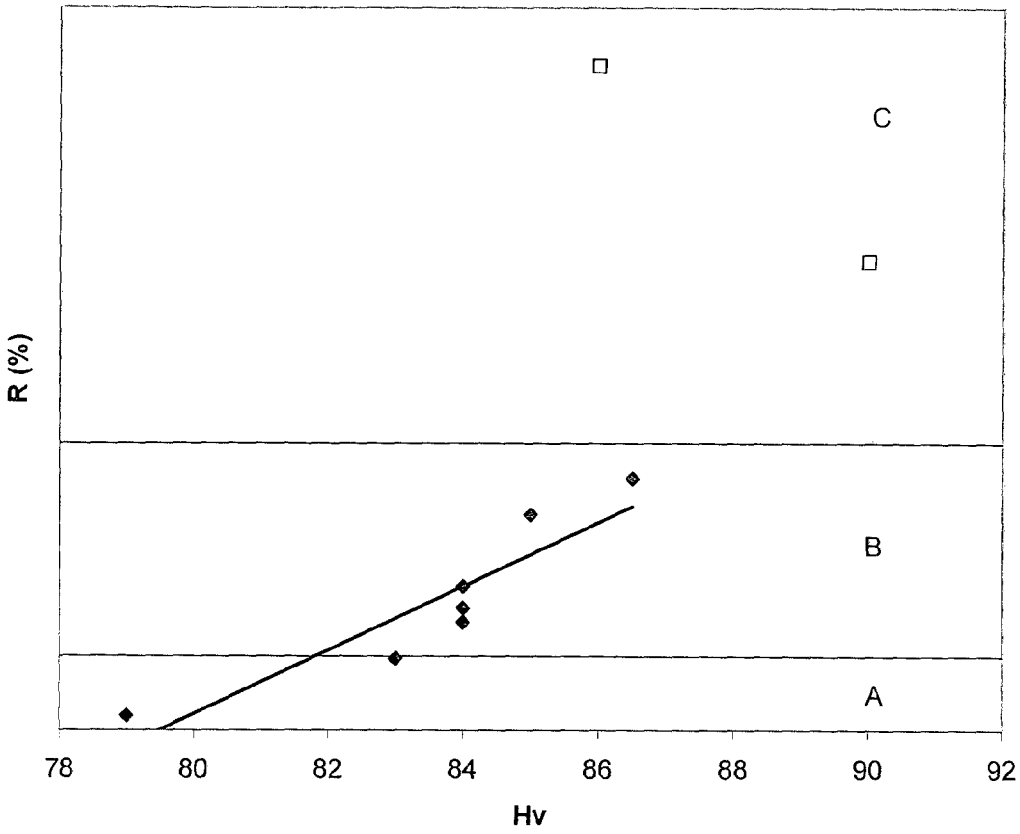

FIG. 3 shows the rejection rate as a %, for three zones (A from 0 to 10%, B from 10 to 30% and C beyond that) during the necking operation as a function of the Vickers Hv microhardness above for materials according to the invention (black lozenges) and non-conforming materials (white squares).

DETAILED DESCRIPTION OF A PREFERRED EMBODIMENT

The invention comprises a careful choice of the alloy and heat treatment, and the transformation range of the sheet or strip used to manufacture the metal bottles or "bottle-cans" or aerosol cans.

The purpose of this optimization is to obtain a material capable of:

- undergoing extensive deep drawing to manufacture the cups with stamping ratios of up to 1.9 or even more, with high necking deformation, to obtain a large reduction in diameter in only two necking passes,
- limiting the risk of defects known to those skilled in the art as "ears" and folds, to prevent any breakage during drawing,
- allowing deformation without breakage when necking and during shaping the thread in the case of bottles and the curl in the case of bottles and aerosol cans,
- enabling the finished product to withstand a sufficient "reversal and/or bursting pressure", typically varying from 6.2 (the standard minimum for bottle-cans) to 17 bars in the case of aerosol cans.

For this purpose the chemical composition of the alloy expressed as percentages by weight (% by weight) is as follows:

Si: 0.10-0.35, Fe: 0.30-0.55, Cu: 0.05-0.20, Mn: 0.70-1.0, Mg: 0.80-1.30, Zn: ≤0.25, Ti: <0.10, other elements <0.05 each, and <0.15 in all, the remainder aluminum.

The concentration ranges imposed on the components of each alloy are explained by the following reasons:

Si is essentially an impurity and as such its concentration must be limited to 0.35% and even better 0.30%.

However a minimum of 0.10% and preferably 0.20% makes it possible to obtain a sufficient level of the $Al(Fe, Mn)_{12}Si$ phase at the end of homogenization treatment after the strip has been cast. This type of abrasive phase has in effect the special feature of preventing fouling of the ironing dies by agglomerations of alloy and oxide particles and thus ensure a good surface quality for the blanks preventing what those skilled in the art know as "jamming".

Fe is also generally an impurity, and therefore its concentration increases during recycling. This must be less than 0.55% and preferably 0.50% to prevent the formation of coarse primary phases during casting, phases which have adverse effect on formability.

However a Si content of at least 0.10% and better 0.20%, as well as a Fe concentration of 0.30% and better 0.35%, is necessary for good control of the anisotropy of the final product, that is to say the sheet or strip, and therefore subsequent shaping operations.

The elements Cu, Mn and Mg are essentially hardening elements whose concentrations make it possible to control the mechanical properties of the sheet at various stages in manufacture, from the blank to the final product.

Hardening is mainly associated with the presence of these elements in solid solution within the primary aluminum matrix. Cu also makes hardening possible through precipitated fines.

Cu has a concentration limited to 0.20% to encourage restoration during the varnish baking heat treatment and thus improve the formability required, particularly for necking and for threading and/or curling.

Mn is limited to 1.0% and better 0.90% to prevent the formation of coarse primary phases during casting, which have an adverse effect on formability.

Mg is limited to 1.3% and better 1.25% so as not to reduce formability too significantly, particularly for stamping operations.

However, the minimum concentrations of Cu, Mn and Mg ensure the minimum mechanical properties required, in particular for withstanding the internal pressure at the bottom of the bottle or can.

Zn is limited to 0.25% essentially because of legislation on products for food applications reflected in standard NF EN 602.

Ti is an element which refines the structure of the cast material but also forms primary phases which are unfavorable for formability. For this latter reason its concentration is limited to less than 0.1%.

The manufacture of strip according to the invention mainly comprises casting, typically continuous vertical casting (CVC) of slab and scalping it.

Scalped slab then undergoes conventional homogenization and then hot rolling followed by first cold rolling with a reduction ratio of 35 to 80%. In fact the reduction ratio before intermediate annealing must be at least 35% to bring about recrystallization during the said intermediate annealing. It must not exceed 80% so that the reduction brought about after the said intermediate annealing is sufficient to provide mechanical properties within the ranges stated below after annealing at 205° C. for 10 minutes. After this first cold rolling the intermediate product undergoes recrystallization annealing at a temperature of between 300 and 400° C., better between 340 and 360° C., or at a target temperature of 350° C., for at least one hour.

After this annealing, rolling is resumed with a cold reduction ratio of 10 to 35% to a final thickness of 0.35 to 1.0 mm.

The sheets or strips so obtained have a yield strength $Rp_{0.2}$ of between 170 and 210 MPa and an ultimate tensile strength of between 200 and 240 MPa after heat treatment at 205° C. for 10 minutes simulating the cumulative drying treatments after cleaning and baking of the varnishes and inner lining.

These relatively low values in comparison with the prior art for an alloy of the 3104 type but in metallurgical state H19 obviously encourage shaping of the "preform", that is to say of the blank after drawing, inner and outer linings and baking, and therefore most particularly for the necking stage.

These are the result of softening during heat treatment at 205° C. for 10 minutes, i.e. a fall of between 20 and 40 MPa in the $Rp_{0.2}$ yield strength in particular.

Another advantage of the invention is an anisotropy index which reflects the ability of the metal to be shaped in a uniform way when manufacturing the cups and drawing them, measured by the cups method according to standard NF EN 1669, of between 0.5 and 4.0%.

After stamping of the cups this is in particular reflected by the fact that the developed shape of the perimeter, known to those skilled in the art as "earing" has ears at 45° on either side of the rolling direction and substantially none at 0 and 180° to the said direction on completion of the test according to the cup method or after the cups had been stamped. Now it has been found that it is the ears at 0 and/or 180° C. which are responsible for the defects known to those skilled in the art as "ears" which can give rise to breakages or defects during subsequent drawing.

Furthermore it is possible to stamp the material or strip according to the invention without breakages or folds with a stamping ratio of 1.5 to 1.9 in a first pass and with a stamping ratio of 1.3 to 1.6 in a second pass, which is equivalent to an overall stamping ratio of up to 2.8. This mode is not however exclusive, as stamping may be performed in more than two passes.

Finally, the sheet according to the invention is also characterized in that after cold rolling to a thickness of 0.35 to 1.0 mm it has an elongated grain microstructure with an aspect ratio, the ratio between the grain size in the rolling direction in relation to the grain size in the direction of the thickness, of between 2 and 10 when measured by optical microscopy with polarized light after anodic oxidation.

The details of the invention will be understood better with the help of the examples below, which are not however restrictive in their scope.

EXAMPLES

Example 1

Two type 3104 alloy slabs were cast by continuous vertical casting and their compositions are summarized in Table 1 below as percentages by weight (% w/w):

TABLE 1

| | Si | Fe | Cu | Mn | Mg |
|---|---|---|---|---|---|
| Reference | 0.13 | 0.45 | 0.17 | 0.86 | 1.2 |
| Invention | 0.27 | 0.42 | 0.11 | 0.86 | 1.19 |

Both were scalped and then homogenized at a temperature of approximately 580° C. for around 3 hours before being hot rolled to a thickness of 2.8 mm.

One of these ("Reference") was then directly cold rolled to a final thickness of 0.505 mm, that is in metallurgical state H19.

The other ("Invention") was cold rolled to a thickness of 0.65 mm and then received recrystallization annealing at 350° C. for one hour followed by final cold rolling to a thickness of 0.505 mm. Metallurgical state H14 was thus achieved.

Cups were made from the two types of sheet reference "3104 H14" and "3104 H19" with the following parameters:

Diameter of the circular blank: 140 mm

Punch diameter: 88.9 mm

Stamping clearance ((diameter of the stamping die−diameter of the punch−2×thickness of the sheet)/2×thickness of the sheet): 30%

Prelubrication of the tool with "Quakerol 30 LVE" with a target quantity of 20 mg/cup. Stamping rate: 60 strokes/min.

Figure 1:
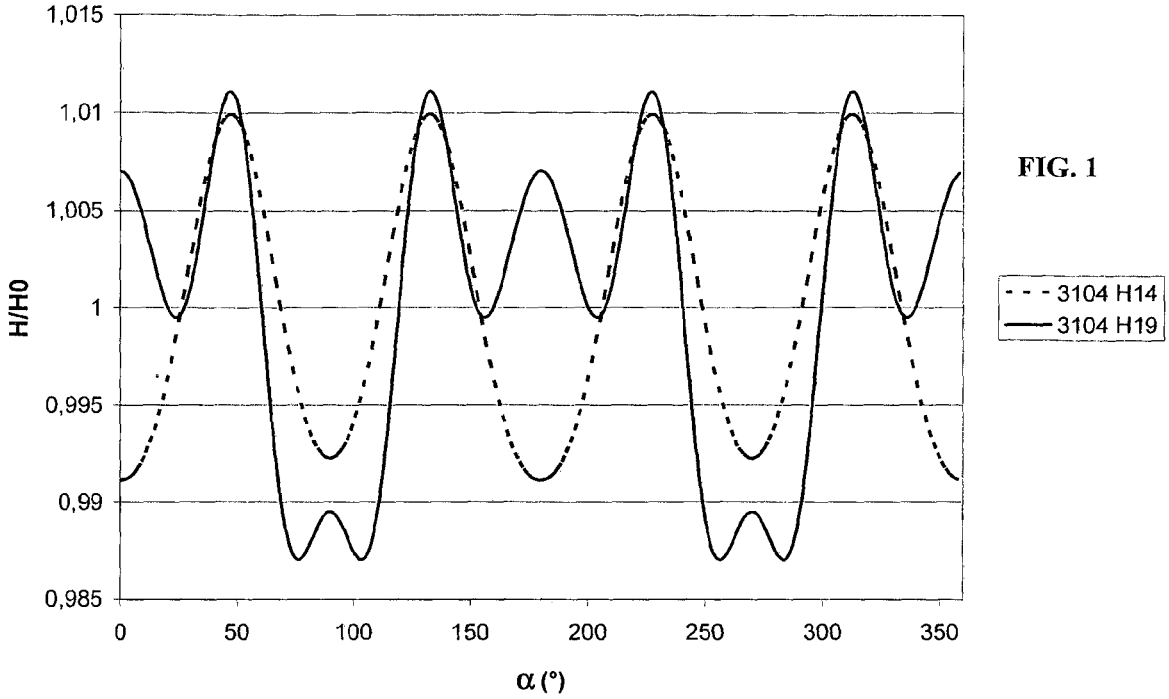
FIG. 1 shows the "earing", that is to say the shape of the perimeter developed at the top of the cups after the first stamping with the ratio of the height of the ear to the mean height of the cup as the ordinate and the angle $\alpha$ in relation to the direction of rolling as the abscissa.

The ear "profiles" are summarized in FIG. 1 corresponding on average to 10 cups of each type ("3104 H14" according to the invention and "3104 H19" according to the prior art).

It was noted that the cups according to the invention were of better quality than those in the prior art, i.e. they had fewer folds and above all, as FIG. 1 shows, there were no ears at 0 and 180° C. to the rolling direction, thus no earing, which is not the case with cups according to the prior art.

The profile according to the invention has ears at 45° on either side of the rolling direction, that is 45°, 135°, 225° and 315°, which do not give rise to the risk of earing", unlike the ears at 0 and 180° in the cups according to the prior art.

Example 2

Nine alloy slabs of the 3104 type were cast by continuous vertical castings and their compositions are summarized in Table 2 below as percentages by weight (% w/w):

TABLE 2

| | | Si | Fe | Cu | Mn | Mg |
|---|---|---|---|---|---|---|
| Reference | 1 | 0.13 | 0.45 | 0.17 | 0.86 | 1.20 |
| Reference | 2 | 0.26 | 0.42 | 0.15 | 0.95 | 1.20 |
| Invention | 3 | 0.27 | 0.42 | 0.11 | 0.86 | 1.19 |
| Invention | 4 | 0.26 | 0.42 | 0.12 | 0.85 | 1.20 |
| Invention | 5 | 0.25 | 0.42 | 0.11 | 0.85 | 1.22 |
| Invention | 6 | 0.26 | 0.43 | 0.12 | 0.84 | 1.21 |
| Invention | 7 | 0.26 | 0.42 | 0.11 | 0.87 | 1.20 |
| Invention | 8 | 0.27 | 0.43 | 0.11 | 0.82 | 1.21 |
| Invention | 9 | 0.27 | 0.43 | 0.11 | 0.82 | 1.21 |

Slab 1 underwent the same range of transformation as the reference slab in example 1, that is without recrystallization annealing, and the other strips 2 to 9 underwent the same range of transformation as the previous one as far as cold rolling, namely:

They were all scalped and then homogenized at a temperature of around 580° C. for approximately 3 hours before being hot rolled to a thickness of 2.8 mm.

They were then cold rolled with difference reduction ratios in accordance with Table 3 below:

TABLE 3

| | | Thickness before annealing mm | Ratio reduction further % | $Rp_{0.2}$ after 10 min. - 205° C. | Rm after 10 min. - 205° C. | $\Delta Rp_{0.2}$ before - after 205° C. | Hv of the preforms | Rejection during necking |
|---|---|---|---|---|---|---|---|---|
| Reference | 1 | — | — | 233 | 257 | 15.0 | 86 | C |
| Reference | 2 | 0.80 | 37 | 214 | 247 | 30.0 | 90 | C |
| Invention | 3 | 0.77 | 34 | 204 | 231 | 31.0 | 84 | B |
| Invention | 4 | 0.77 | 34 | 204 | 229 | 30.0 | 84 | B |
| Invention | 5 | 0.77 | 34 | 206 | 234 | 34.0 | 87 | B |
| Invention | 6 | 0.72 | 30 | 200 | 225 | 32.0 | 85 | B |
| Invention | 7 | 0.72 | 30 | 202 | 229 | 35.0 | 84 | B |
| Invention | 8 | 0.65 | 22 | 199 | 221 | 26.0 | 83 | A |
| Invention | 9 | 0.58 | 13 | 193 | 204 | 20.0 | 79 | A |

Materials 1 and 2 are not conforming to the invention because there was no intermediate annealing and the reduction ratio and cold rolling after annealing was 37% against a maximum of 35% according to the invention.

The $Rp_{0.2}$ yield strength in MPa and the ultimate tensile strength Rm in MPa after the said treatment were then measured on sheets after cold rolling before and after treatment simulating baking of the varnishes.

These values are shown in Table 3 together with the difference in $\Delta Rp_{0.2}$ before and after the said treatment.

It will be noted that the yield strength measured in this way varies from 193 to 204 MPa, whereas it is higher (214

MPa) for reference 2 and even more so in the case of reference 1 (233 MPa), which is encouraging for the formability of the sheets according to the invention.

It will also be noted that the difference in yield strengths before and after the said treatment vary from 20 to 35 MPa for sheets according to the invention, whereas it is only 15 MPa for reference 1 in the prior art, with the same conclusion as before.

The anisotropy index S45 for all the sheets and S0 for the sheet according to the prior art in metallurgical state H19 (reference 1) was also measured by the cup method according to standard NF EN 1669 after cold rolling to a thickness of 0.505 mm.

The values obtained are shown in Table 4 below.

It will be noted that in the case of sheets according to the invention they all lie between 0.5 and 4.0%, which is not the case for the reference sheets not according to the invention.

Finally the grain structure was identified for these sheets using optical microscopy in polarized light after anodic oxidation with a magnification of 50. The ratio of the grain size in the rolling direction L to that of the grain size in the direction of the thickness or "short cross-section Tc", or in a plane (L, Tc) substantially half way across the width of the initial sheet was measured for this purpose.

The values shown in Table 4 below correspond to an average of approximately 50 measurements for each case.

It will be noted that the sheets according to the invention all have a slenderness ratio of between 1 and 10, and in the case in point between 3 and 5, whereas this reaches a value of 30 in the case of the sheet according to the prior art in metallurgical state H19 (reference 1).

TABLE 4

| | | Anisotropy index S 45 (%) | Anisotropy index S 0 (%) | Grain aspect ratio |
|---|---|---|---|---|
| Reference | 1 | 4.5 | 1.7 | 30 |
| Reference | 2 | 4.1 | — | 5 |
| Invention | 3 | 3.4 | — | 5 |
| Invention | 4 | 3.5 | — | 5 |
| Invention | 5 | 3.8 | — | 5 |
| Invention | 6 | 2.0 | — | 5 |
| Invention | 7 | 3.2 | — | 5 |
| Invention | 8 | 3.0 | — | 4 |
| Invention | 9 | 2.9 | — | 3 |

A series of manufacturing tests for metal bottles of the "bottle-can" type having a capacity of 33 cl was then performed using blanks and cups identical to those in Example 1 made from sheet of types 1 to 9 in accordance with Table 3 in a wholly conventional range.

Necking or "tapering" consisted of reducing the diameter of the preform from 57 mm to 28 mm over a neck height of 70 mm.

After "tapering" the neck was threaded and then curled.

These tests were carried out on 3000 to 5000 bottles for each material 1 to 9.

In the course of the tests, samples were obtained at the stage of the varnished preform after baking, that is precisely before the necking operation, to measure the Vickers microhardness of the preforms under a load of 100 grams, after cutting, coating and polishing.

The results are shown in Table 3 and FIG. 2 shows the values for this hardness of the preforms as a function of the yield strength of the sheets after heat treatment simulating baking of the varnishes.

The black lozenges correspond to the metal according to the invention, and the white squares to materials 1 and 2 not conforming to the invention.

This figure shows a linear correlation between these two values for materials prepared with intermediate recrystallization annealing (black lozenges and white squares) having the coordinates: 90 Hv and 214 (MPa)

After the necking operation visual checks were made to eliminate any items showing defects such as folds in the neck of the bottle, folds on the screw, the curl of the bottle showing cracks which were open to a greater or lesser extent, known as "split curl", absence of varnish, incrustations, crushed thread, scratches, etc.

A classification from A to C was made on the basis of the number of items eliminated as a %, i.e. the "rejection rate". This classification was established as follows:

A for a rejection rate of 0 to 10%, B for 10 to 30% and C above that.

The results are shown in Table 3 and FIG. 3 shows the rejection rate as a % according to the three predetermined zones from A to C during the necking operation as a function of the Vickers Hv microhardness above, for materials according to the invention (black lozenges) and non-conforming materials (white squares).

The better performance of the materials according to the invention in relation to the materials not conforming to the invention can be seen unambiguously and in particular the material according to the prior art yielded the worst result (highest rejection).

The invention claimed is:

1. Process for the manufacture of an aluminum alloy sheet for metal bottles or aerosol cans manufactured by drawing-ironing and necking comprising:

casting a slab of aluminum alloy having a composition (% by weight):

Si: 0.10-0.35, Fe: 0.30-0.55, Cu: 0.05-0.20, Mn: 0.70-1.0, Mg: 0.80-1.30, Zn: <0.25, Ti: <0.10, other elements <0.05 each, and <0.15 in all, the remainder aluminum, scalping and homogenization of the slab at a temperature of 550 to 630° C. for at least one hour, hot rolling, first cold rolling stage with a reduction ratio of 35 to 80%, recrystallization annealing, repeated cold rolling with a reduction ratio of 10 to 35% to a thickness of 0.35 to 1.0 mm, wherein the recrystallization annealing is carried out at a temperature of 300 to 400° C. for a period of at least one hour, wherein the manufactured aluminum alloy sheet has a yield strength of 170 to 200 MPa and ultimate tensile strength of 200 to 230 MPa after a heat treatment at 205° C. for 10 minutes simulating a baking of varnishes.

2. Process according to claim 1 wherein the annealing crystallization is carried out at a temperature of 340 to 360° C. over a period of at least one hour.

3. A process according to claim 1, wherein the manufactured aluminum alloy sheet has a fall in the yield strength of 20 to 40 MPa before and after the heat treatment simulating baking of varnishes.

4. A process according to claim 1, wherein the manufactured aluminum alloy sheet has an anisotropy index of 1 to 4%, measured after cold rolling to a thickness of 0.35 to 1.0 mm by a cup method according to standard NF EN 1669.

5. A process according to claim 1, wherein on completion of a test according to a cup method according to standard NF EN 1669, said manufactured aluminum alloy sheet has ears at 45° on either side of a direction of rolling and substantially no ears at 0 and 180° to said direction.

6. A process according to claim 1, wherein the manufactured aluminum alloy sheet has a formability such that said sheet shows no cracks or folds when deep drawn in two passes, a former with a stamping ratio, the ratio between the diameter of a blank and the diameter of a punch, between 1.5 and 1.9, a latter with a stamping ratio of between 1.3 and 1.6.

7. A process according to claim 1, wherein the manufactured aluminum alloy sheet has an elongated grain microstructure with an aspect ratio from 2 and 10, wherein the aspect ratio is a ratio of a grain size in a direction of rolling in relation to the grain size in a direction of thickness, measured after cold rolling to a thickness of 0.35 to 1.0 mm and after anodic oxidation and using optical microscopy with polarized light.

8. A method according to claim 1, wherein the manufactured aluminum alloy sheet has an elongated grain microstructure with an aspect ratio from 3 and 5, wherein the aspect ratio is a ratio of a grain size in a direction of rolling in relation to the grain size in a direction of thickness, measured after cold rolling to a thickness of 0.35 to 1.0 mm and after anodic oxidation and using optical microscopy with polarized light.

9. The process of claim 1, wherein said aluminum sheet consists essentially of Si: 0.10-0.35, Fe: 0.30-0.55, Cu: 0.05-0.20, Mn: 0.70-1.0, Mg: 0.80-1.30, Zn: <0.25, Ti: <0.10, other elements <0.05 each, and <0.15 in all, the remainder aluminum.

10. The process of claim 1, wherein said aluminum sheet consists of Si: 0.20-0.30, Fe: 0.35-0.50, Cu: 0.05-0.15, Mn: 0.80-0.90, Mg: 1.15-1.25, Zn: <0.25, Ti: <0.10, other elements <0.05 each, and <0.15 in all, the remainder aluminum.

11. Process according to claim 1, wherein the aluminum alloy has the following composition (% by weight):

Si: 0.20-0.30, Fe: 0.35-0.50, Cu: 0.05-0.15, Mn: 0.80-0.90, Mg: 1.15-1.25, Zn: <0.25, Ti: <0.10, other elements <0.05 each, and <0.15 in all, the remainder aluminum.

12. Sheet manufactured by the process according to claim 11.

13. Sheet according to claim 12, wherein the aluminum alloy has the following composition (% by weight):

Si: 0.25-0.27, Fe: 0.42-0.43, Cu: 0.11-0.12, Mn: 0.82-0.87, Mg: 1.19-1.22, Zn: <0.25, Ti: <0.10, other elements <0.05 each, and <0.15 in all, the remainder aluminum.

14. The sheet of claim 12, wherein said aluminum sheet consists essentially of Si: 0.10-0.35, Fe: 0.30-0.55, Cu: 0.05-0.20, Mn: 0.70-1.0, Mg: 0.80-1.30, Zn: <0.25, Ti: <0.10, other elements <0.05 each, and <0.15 in all, the remainder aluminum.

15. The sheet of claim 12, wherein said aluminum sheet consists of Si: 0.20-0.30, Fe: 0.35-0.50, Cu: 0.05-0.15, Mn: 0.80-0.90, Mg: 1.15-1.25, Zn: <0.25, Ti: <0.10, other elements <0.05 each, and <0.15 in all, the remainder aluminum.

16. Metal bottle, wherein said metal bottle is manufactured by extrusion/drawing and necking the sheet manufactured according to the process of claim 1.

17. Shaped metal bottle, wherein said shaped metal bottle is manufactured by extrusion/drawing and necking the sheet manufactured according to the process of claim 1.

18. Aerosol container, wherein said aerosol container is manufactured by extrusion/drawing and necking the sheet manufactured according to the process of claim 1.

19. Shaped aerosol can, wherein said aerosol can is manufactured by extrusion/drawing and necking the sheet manufactured according to the process of claim 1.

* * * * *